US006179500B1

(12) United States Patent
Oura et al.

(10) Patent No.: US 6,179,500 B1
(45) Date of Patent: Jan. 30, 2001

(54) KEYBOARD DEVICE CAPABLE OF ENSURING POSITIONING AND FIXING OF KEYBOARD BODY RELATIVE TO CASE

(75) Inventors: Nobuhiro Oura; Hideki Ito, both of Fukushima-ken (JP)

(73) Assignee: Alps Electric Co., Ltd., Tokyo (JP)

( * ) Notice: Under 35 U.S.C. 154(b), the term of this patent shall be extended for 0 days.

(21) Appl. No.: 09/407,408

(22) Filed: Sep. 29, 1999

(30) Foreign Application Priority Data

Sep. 30, 1998 (JP) ..... 10-294557

(51) Int. Cl.[7] ..... B41J 29/02
(52) U.S. Cl. ..... 400/693; 400/691
(58) Field of Search ..... 400/693, 691, 400/679, 472, 495, 492, 491.2, 490; 341/22; 345/168, 169; 361/680

(56) References Cited

U.S. PATENT DOCUMENTS 4,549,825 * 10/1985 Fish ..... 400/692
5,253,142 * 10/1993 Weng ..... 400/493
5,421,659 6/1995 Liang ..... 400/472
5,535,091 * 7/1996 Lee ..... 400/472
5,694,123 * 12/1997 Selker et al. ..... 341/22
5,810,491 * 9/1998 Muller et al. ..... 400/472
5,938,352 * 9/1998 Chen ..... 400/472

* cited by examiner

*Primary Examiner*—John S. Hilten
*Assistant Examiner*—Anthony H. Nguyen
(74) *Attorney, Agent, or Firm*—Brinks Hofer Gilson & Lione

(57) ABSTRACT

A keyboard device is disclosed which has a structure capable of ensuring positioning and fixing of a keyboard body relative to a case. The keyboard device has a keyboard body and a case. The case comprises an upper case which covers the upper surface side of the keyboard body and a lower case which covers the lower surface side of the keyboard body. A tongue piece and a cutout portion for engagement with the upper and lower cases are provided centrally of two longitudinally extending inner side and this side of the keyboard body. Positioning and fixing of the keyboard body relative to the case are effected by those two engaging portions. Also at two positions of the inner side of the keyboard body are provided fixing portions for fixing the keyboard body to the case, namely, the upper and lower cases.

7 Claims, 7 Drawing Sheets

KEYBOARD DEVICE CAPABLE OF ENSURING POSITIONING AND FIXING OF KEYBOARD BODY RELATIVE TO CASE

BACKGROUND OF THE INVENTION

1. Field of the Invention

The present invention relates to a keyboard device and particularly to a keyboard body positioning and fixing structure in a keyboard device having a keyboard body and a case which accommodates the keyboard body therein.

2. Description of the Related Art

A conventional keyboard generally has a keyboard body with a large number of key tops attached thereto and a case which accommodates and holds the keyboard body therein. The case is of a combined structure comprising an upper case which covers the upper surface side of the keyboard body and a lower case which covers the lower surface side of the keyboard body, the upper case having window portions through which a large number of key tops are exposed. The reason for adopting this structure is that this structure facilitates the keyboard assembling work. The keyboard body has several kinds of key groups different in function, including ordinary types of input keys, ten keys, and function keys. The key groups are partitioned and somewhat spaced from one another by beam portions each disposed between adjacent window portions formed in the upper case.

Recently, in the field of information processors such as personal computers, there has been an increasing demand for the reduction of size, thickness and weight from the standpoint of space saving and portability improvement. With such a demand as background, also in the field of keyboard as an input device of an information processor, a demand has been being raised to the effect that the keyboard itself should be reduced in size, thickness and weight. In this connection, for reducing the size of conventional keyboards having the above structure, there has been proposed a keyboard in which the number of beam portions for partitioning key groups is decreased, the spacing between adjacent key groups is made smaller, and the width of an outer frame portion is reduced. According to this keyboard, the reduction in size of the keyboard can be implemented in comparison with the other conventional keyboards of the foregoing structure because the key group-to-key group spacing is narrowed and the external frame is reduced in width. Further, the reduction in weight of the keyboard can be attained by using a light-weight resin as the material of the case.

However, although the reduction in size and weight of the keyboard can be attained by making some improvement with respect to the structure and material, other inconveniences have occurred.

For example, at the time of installing the keyboard body into the case, it is necessary to effect positioning of the keyboard body accurately with respect to the case. But, since there is no beam portion crossing above the keyboard body, the positioning of the keyboard body relative to the case is inevitably performed along an edge portion of the keyboard body. In this type of a conventional keyboard, such a positioning is conducted at an end portion of an edge extending in the longitudinal direction of the keyboard body. In such a positioning method, it has been difficult to attain a satisfactory positioning accuracy particularly at the opposite-side end portion. Usually, therefore, a slight clearance is formed between window edges in the upper case and the key tops located on the outermost periphery so as to prevent mutual contact. However, there has been the problem that the clearance is not uniform throughout the whole of the keyboard. Such a problem may be avoided by providing positioning portions at both ends, but in this case an extra space is required for such positioning portions.

The keyboard body is fixed to the lower case with screws or the like from the back side of the lower case so as not to be visible in the normal state of use. No matter how simplified the structure of the case may be for the reduction in size and weight of the keyboard, the case and the keyboard body must not become easily disengaged from each other at their fixed portions when a slight shock is exerted on the keyboard. It is necessary that the keyboard body be held and fixed positively at a predetermined position in the case.

SUMMARY OF THE INVENTION

The present invention has been accomplished for solving the above-mentioned problems and it is an object of the invention to provide a keyboard device having a structure which permits a keyboard body to be positioned and fixed reliably relative to a case.

For achieving the above-mentioned object, the keyboard device of the present invention has a generally rectangular keyboard body with a plurality of key tops attached to the upper surface thereof and a case which accommodates the keyboard body therein, the case comprising an upper case which covers the upper surface side of the keyboard body and a lower case which covers the lower surface side of the keyboard body, the upper case having window portions through which the key tops are exposed, in which keyboard device a first body-side engaging portion is provided centrally of a longitudinally extending side of the keyboard body, a first upper case-side engaging portion for engagement with the first body-side engaging portion is provided centrally in the longitudinal direction of the upper case, and a first lower case-side engaging portion for engagement with the engaged portion of the first body-side engaging portion and the first upper case-side engaging portion is provided centrally in the longitudinal direction of the lower case.

In the conventional keyboard device the positioning of the keyboard body is performed at a longitudinal end of the keyboard body and therefore there occurs a large positional deviation at the opposite-side end portion, whereas in the keyboard device of the present invention the positioning is effected at an engaging portion positioned centrally in the longitudinal direction of the keyboard body, that is, the distance from the positioning portion up to an end portion of the keyboard body is short, so that sufficiently high positioning accuracy is obtained even at the end portion and the clearance between the window edges of the upper case and the key tops positioned at the outermost periphery can be made uniform throughout the whole of the keyboard. Further, since all of the three members, namely keyboard body, upper case and lower case, are engaged with one another centrally in the longitudinal direction of the keyboard body, the positioning accuracy among the three members is improved to a greater extent.

According to one example of a more concrete mode, the first body-side engaging portion, the first upper case-side engaging portion and the first lower case-side engaging portion are formed by projections projecting from the keyboard body, upper case and lower case, respectively, the projection as the first body-side engaging portion being held grippingly between the projections as the first upper and lower case-side engaging portions.

According to this construction, when the above first engaging portions are regarded as both positioning means and fixing means, the keyboard body is fixed firmly between the upper and lower cases because the projection as the first body-side engaging portion is held grippingly between the projections as the upper and lower case-side engaging portions In the above keyboard device of the present invention, preferably, a second body-side engaging portion is provided centrally of the side opposite to the side where the first body-side engaging portion of the keyboard body is provided, and a second case-side engaging portion for engagement with the second body-side engaging portion is provided centrally in the longitudinal direction of at least one of the upper and lower cases. In this case, engaging portions for engagement with the case are respectively provided centrally of the two opposed sides extending in the longitudinal direction of the keyboard body, and thus the positioning of the keyboard body relative to the case is effected by those two engaging portions.

Thus, by positioning the keyboard body and the case relative to each other at the two opposed sides, the keyboard body is prevented from being displaced in a rotational direction thereof and it is possible to improve the positioning accuracy.

Further, in the above keyboard device of the present invention it is preferable that on the side where the first body-side engaging portion of the keyboard body is provided, third body-side engaging portions be provided at two positions spaced from each other with the first body-side engaging portion therebetween and that third upper case-side engaging portions and third lower case-side engaging portions each for engagement with the third body-side engaging portions be provided in the upper and lower cases, respectively.

In this case, not only are engaging portions for engagement with the case provided at two spaced positions on one longitudinal side of the keyboard body, but also an engaging portion (the second engaging portion) for engagement with the case is provided centrally of the side of the keyboard body opposed to the side where the above engaging portions are provided, and thus the keyboard body is fixed at these three engaging portions relative to the case.

According to this construction, the keyboard body, the upper case and the lower case are fixed respectively at the apexes of a triangle constituted by two third engaging portions and one second engaging portion, so even if external forces are exerted on the keyboard in various directions, those three components are held in a firmly fixed state. Thus, it is possible to provide a keyboard device which is strong against a mechanical shock.

BRIEF DESCRIPTION OF THE DRAWINGS

FIG. 3 is a diagram showing a state of engagement using a tongue piece of the keyboard body in the keyboard device, in which

FIG. 4 is a diagram showing a state of engagement using a third cutout portion of the keyboard body in the keyboard device, in which

FIG. 6 is a diagram showing a structure for fixing the upper and lower cases to each other in the keyboard device, in which

DESCRIPTION OF A PREFERRED EMBODIMENT

An embodiment of the present invention will be described hereunder with reference to FIGS. 1 to 7.

Figure 1:
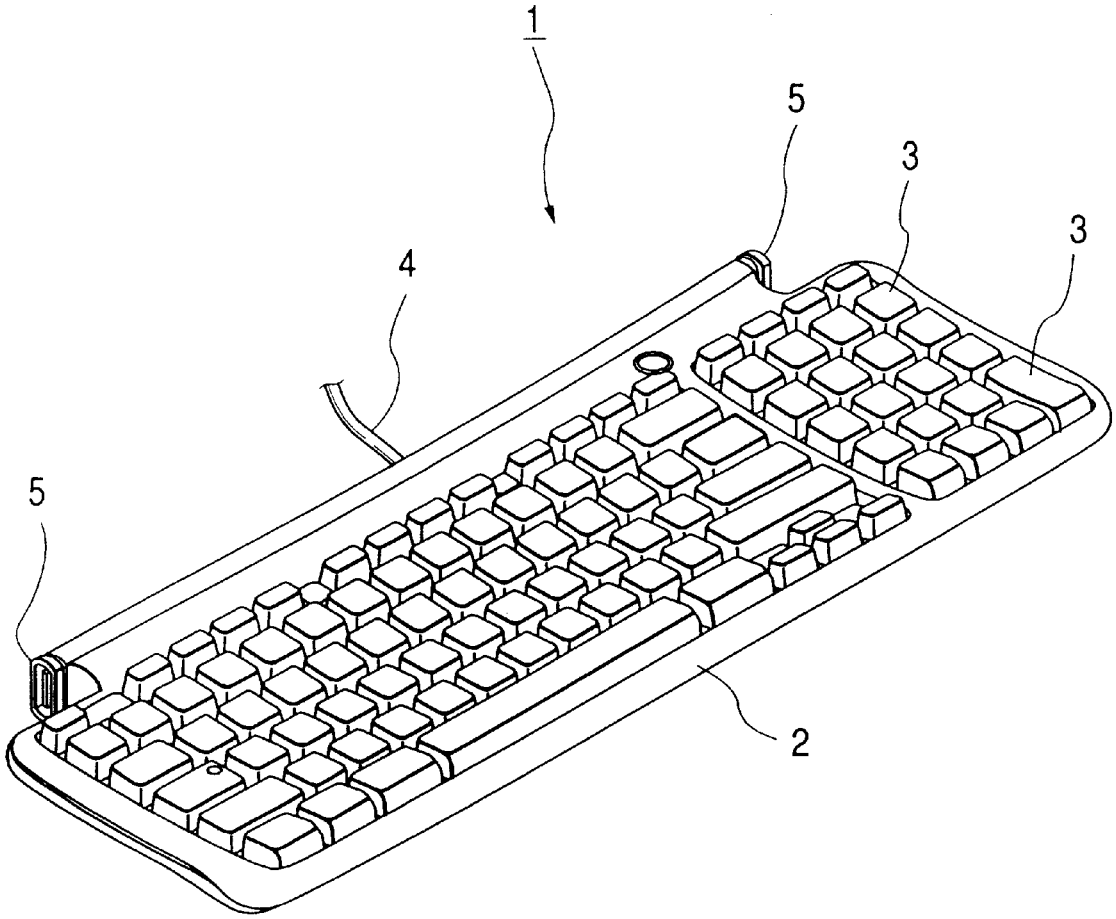
FIG. 1 is a perspective view showing an entire construction of a keyboard device according to an embodiment of the present invention.

FIG. 1 is a diagram showing an entire construction of a keyboard device 1 embodying the present invention. The keyboard device 1 is a transparent keyboard of small size and small thickness in which a case 2 and key tops 3 are formed of a transparent resin. A cable 4 for connection to, say, a computer body (not shown) is drawn out from a rear side of the keyboard device 1 (the inner side and this side as seen from the user side may sometimes be referred to as rear side and front side, respectively), and connectors 5 conforming to the USB standard for common connection to various external devices are attached to side faces on the rear side of the keyboard device 1.

Figure 2:
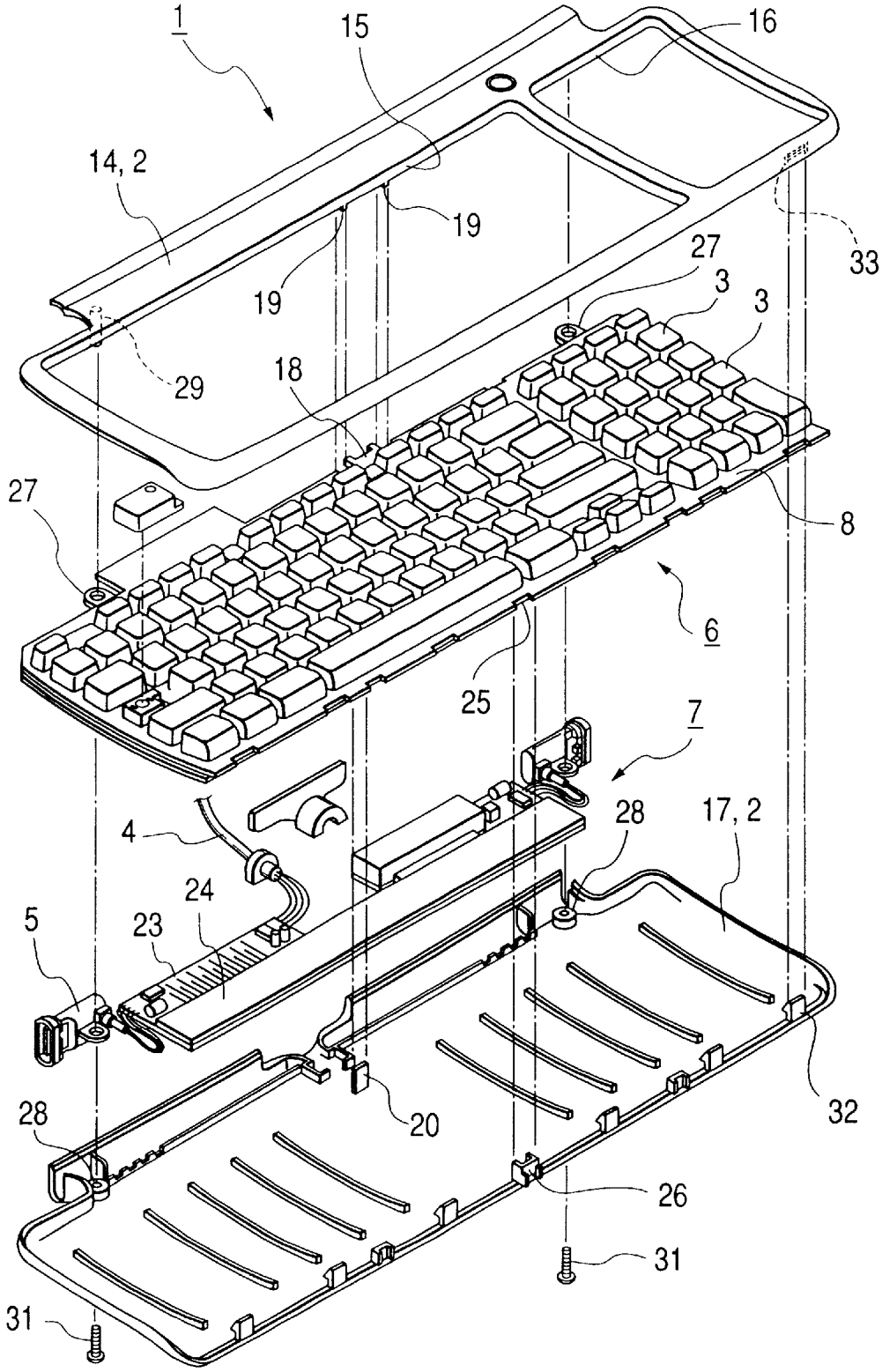
FIG. 2 is a perspective view showing an exploded state of an upper case, a keyboard body and a lower case of the keyboard device.
Figure 5:
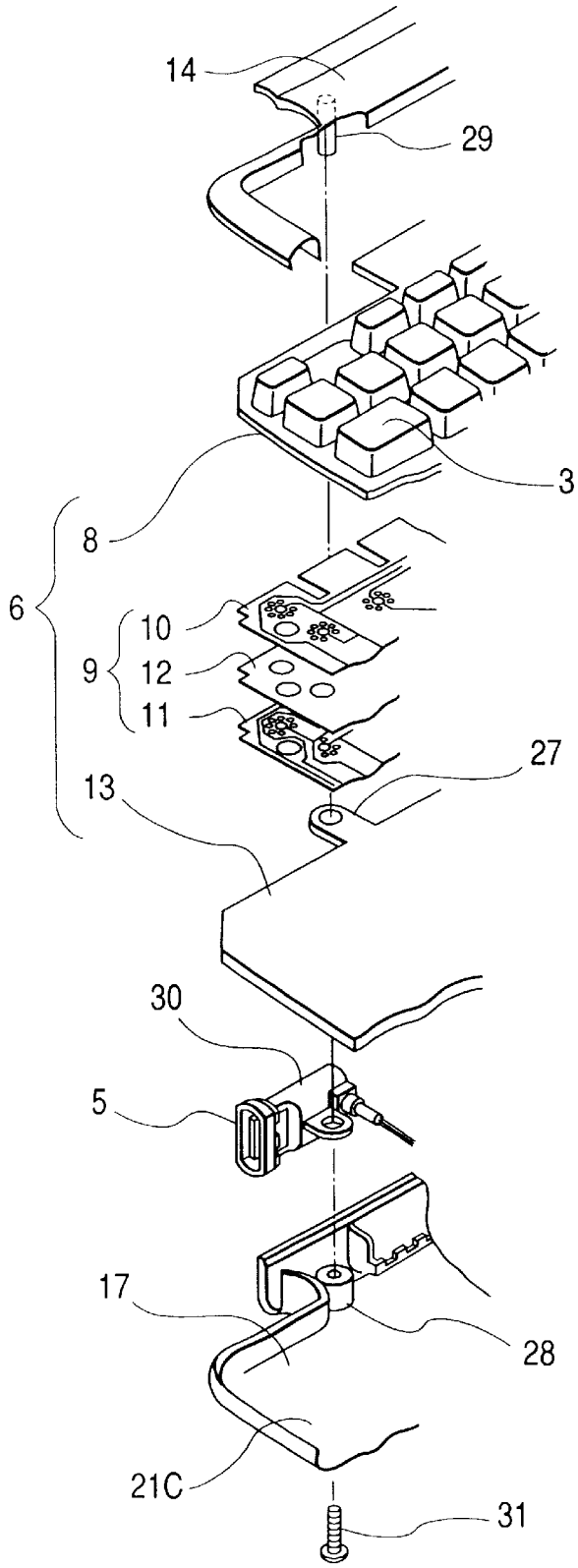
FIG. 5 is an exploded perspective view of components, showing a state of engagement using an annular fixing portion of the keyboard body in the keyboard device.

The keyboard device of this embodiment, as shown in FIG. 2, is substantially composed of a generally rectangular keyboard body 6 with a large number of key tops 3 attached thereto, a case 2 which accommodates the keyboard body 6 therein, and a control unit 7 which controls the transmission and reception of various signals to and from a computer body for example. The keyboard body 6, as shown in FIG. 5, comprises a housing 8 which supports a large number of key tops 3, three sheets which constitute a membrane switch 9 and which are two circuit sheets 10, 11 and one spacer sheet 12, and a metallic plate 13 which holds and supports the three sheets 10, 11 and 12 between it and the housing 8.

The case 2 comprises an upper case 14 which covers the upper surface side of the keyboard body 6 and a lower case 17 which covers the lower surface side of the keyboard body 6, the upper case 14 having window portions 15 and 16 through which plural key tops 3 are exposed. The window portion 15 of the upper case 14 is for the exposure of ordinary input keys and function keys, while the window portion 16 is for the exposure of ten keys, with a slight clearance being formed between the edges of both window portions 5 and 6 and the key tops 3 located at the outermost periphery. For making this clearance uniform throughout the whole circumference of the window portions 15 and 16 and for preventing wobbling of the keyboard body 6 within the case 2, the keyboard body 6 and the case 2 are established their positions and fixed at the following three places.

As shown in FIG. 2, nearly centrally of the inner side of the metallic plate 13 as a constituent of the keyboard body 6, out of the two longitudinally extending sides of the keyboard body, there is provided a tongue piece 18 (a first body-side engaging portion, a projection) which projects horizontally to the inner side, while on the upper case 14 side is provided two downwardly projecting projections 19 (a first upper case-side engaging portion, a projection) of a position corresponding to the tongue piece 18 of the keyboard 6. On the lower case 17 side is provided an upwardly projecting tongue piece 20 (a first lower case-side engaging portion, a projection) at a position corresponding to the tongue piece 18 of the keyboard body 6.

Figure 3A:
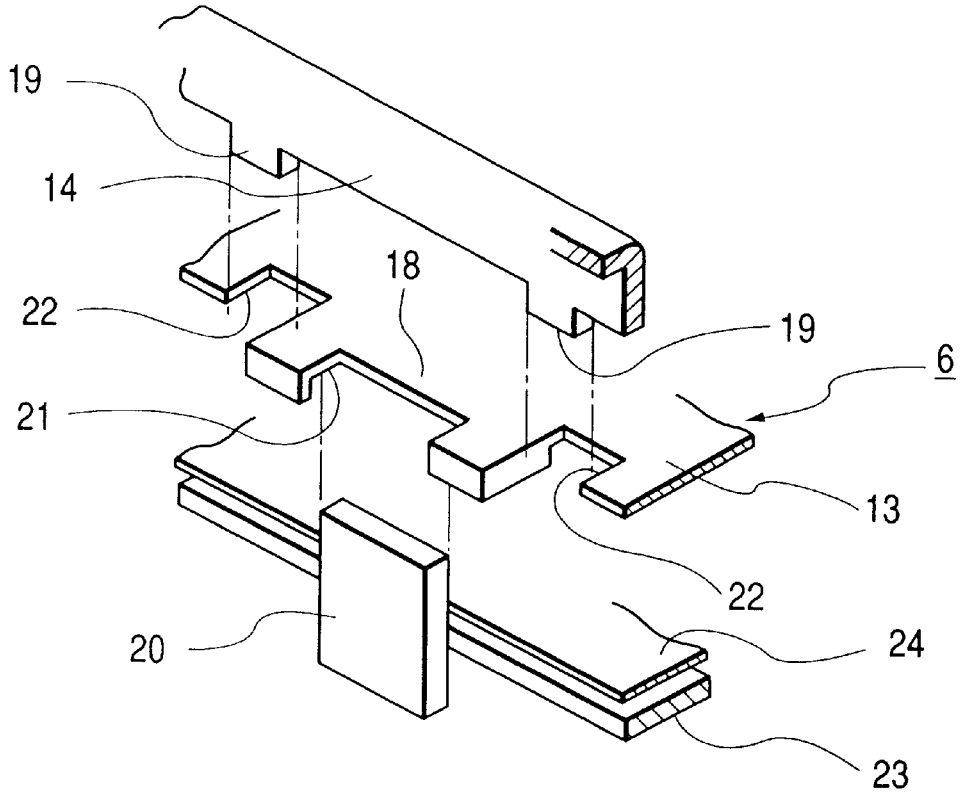
FIG. 3A is a perspective view showing an exploded state and FIG. 3B is a perspective view showing an assembled state.
Figure 3B:
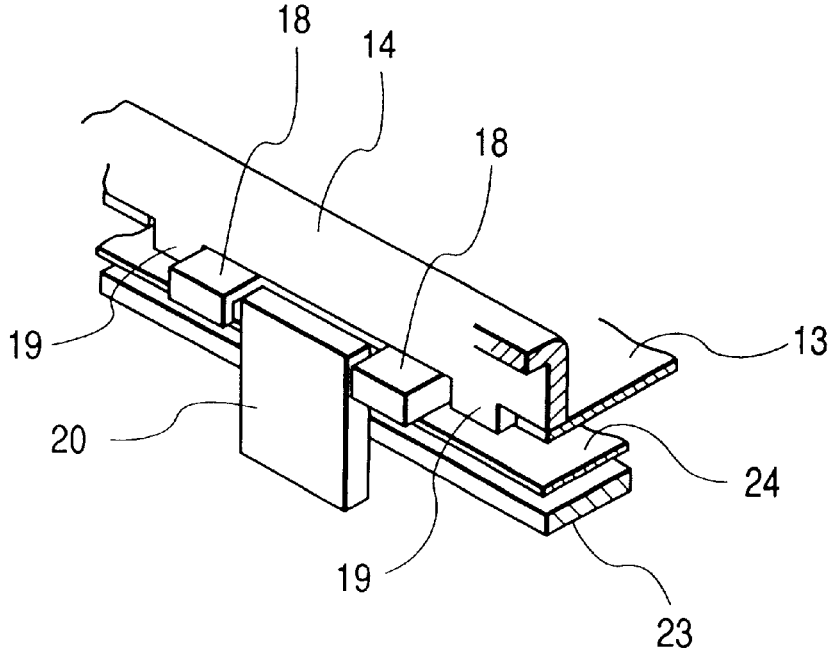

FIGS. 3A and 3B are enlarged diagrams of the portion in question. As shown in FIG. 3A, a first cutout portion 21 (a first body-side engaging portion) is formed centrally in the width direction of the tongue piece 18 of the keyboard body 6. The width of the first cutout portion 21 is equal to the width of the tongue piece 20 of the lower case 17 On both sides of the tongue piece 18 of the keyboard body 18 are formed second cutout portions 22 (first body-side engaging portions) by cutting out the metallic plate 13 inwards. The width of each cutout portion 22 is equal to the width of each projection 19 of the upper case 14 and the spacing between the second cutout portions 22 is equal to the spacing between the projections 19 of the upper case 14. The numerals 23 and 24 in FIG. 3A denote a printed circuit board and a shielding plate, respectively, in the control unit 7 disposed between the lower case 17 and the keyboard body 6.

The shapes of various components located in this portion are as described above. In an assembled state of the keyboard device 1, as shown in FIG. 3B, the first cutout portion 21 of the tongue piece 18 in the keyboard body 6 and the tongue piece 20 of the lower case 17 are engaged with each other and the two second cutout portions 22 in the keyboard body 6 and the two projections 19 of the upper case 14 are respectively engaged with each other. Thus, the tongue piece 18 of the keyboard body 6 is held grippingly between the tongue piece 20 of the lower case 17 and the two projections 19 of the upper case 14.

Figure 4A:
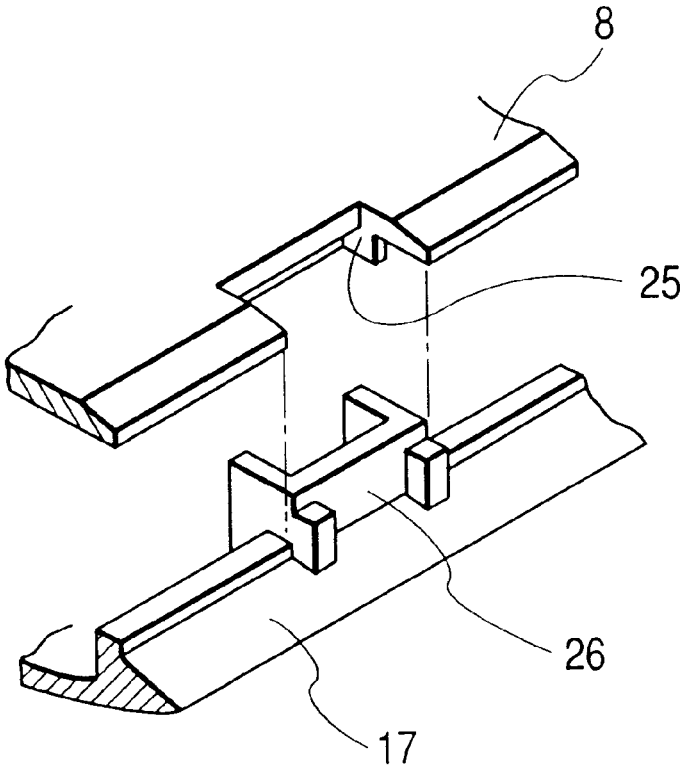
FIG. 4A is a perspective view showing an exploded state and FIG. 4B is a perspective view showing an assembled state.
Figure 4B:
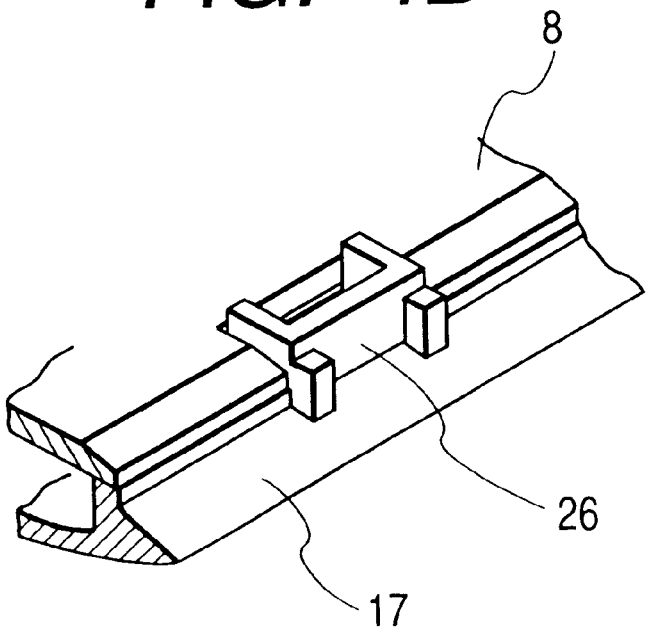

As shown in FIG. 2, a third cutout portion 25 (a second body-side engaging portion) is formed nearly centrally of this side of the housing 8 as a constituent of the keyboard body 6, out of the two longitudinally extending sides of the keyboard body, while in the lower case 17 is formed a projection 26 (a second case-side engaging portion) at a position corresponding to the third cutout portion 25 of the keyboard body 6, the projection 26 being H-shaped in plan and projecting upward. The width of the third cutout portion 25 is equal to the width of the projection 26 of the lower case 17. FIGS. 4A and 4B are enlarged diagrams of this portion. In an assembled state of the keyboard device 1, as shown in FIG. 4B, the third cutout portion 25 of the keyboard body 6 and the inner U-shaped portion of the projection 26 of the lower case 17 are engaged with each other.

Thus, in the keyboard device 1 of this embodiment, there is made positioning at two central portions of the two longitudinally extending sides of the keyboard body 6.

As shown in FIG. 2, on the inner side extending in the longitudinal direction of the metallic plate 13 of the keyboard body 6 are formed two annular fixing portions 27 (third body-side engaging portions) at two right and left positions with the central tongue piece 18 therebetween so as to project horizontally toward the inner side, the annular fixing portions 27 each having a central hole. At positions of the lower case 17 corresponding to the fixing portions 27 of the keyboard body 6 are provided screw bosses 28 (third lower case-side engaging portions) for fixing the keyboard body 6 and the upper case 14. Further, at positions of the upper case 14 corresponding to the fixing portions 27 of the keyboard body 6 are provided cylindrical screw bosses 29 (third upper case-side engaging portions) (only one is shown in FIG. 2 for the convenience of illustration), the screw bosses 29 being each internally formed with a tapped hole (not shown). The inside diameter of the hole formed in each fixing portion 27 of the keyboard body 6 is larger than the outside diameter of each screw boss 29 of the upper case 14 so that the screw boss 29 can be inserted into the hole of the fixing portion 27.

In the keyboard device 1 of this embodiment, the portion in question is used not only for fixing the case 2 and the keyboard body 6 to each other but also for fixing the USB connectors 5. As shown in FIG. 5, therefore, each screw boss 29 of the upper case 14 can also be inserted into a hole formed in a connecting portion 30 of each USB connector 5. In an assembled state of the keyboard device 1, the screw bosses 29 of the upper case 14 are inserted successively from above into the holes of the fixing portions 27 in the keyboard body 6 and the holes of the connecting portions 30 of the USB connectors 5, and when the screw bosses 29 of the upper case 14 and the screw bosses 28 of the lower case 17 come into abutment so as to be aligned with each other, screws 31 are threadedly engaged with the lower case 17 from below, whereby the upper case 14, keyboard body 6 and lower case 17 are fixed together.

Thus, in the keyboard device 1 of this embodiment, the upper case 14, keyboard body 6 and lower case 17 are fixed at two positions on the inner side of the keyboard body, the lower case 17 and the keyboard body 6 are fixed together by one engaging portion (the portion of engagement of the third cutout portion 25 with the projection 26 of the lower case 17) provided centrally of this side of the keyboard body 6, and the case 2 and the keyboard body 6 are fixed together at three positions corresponding to the apexes of a triangle formed by those engaging portions.

The case 2 comprising the upper case 14 and the lower case 17 is fixed with screws at the fixing portions 27 of the keyboard body 6 and is also fixed at the front side of the case 2. As shown in FIG. 2, upwardly projecting hook portions 32 are formed at plural positions (six positions in this embodiment) of the front edge of the lower case 17, while on the front edge side of the upper case 14 are formed downwardly projecting hook receiving portions 33 (only one is shown in FIG. 2 for the convenience of illustration) at positions corresponding to the positions of the hook portions 32.

Figure 6A:
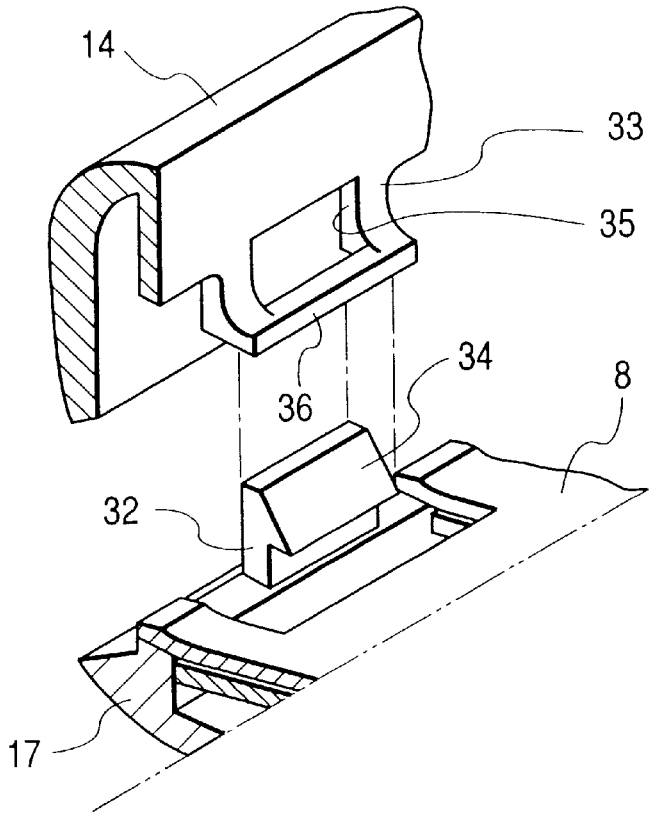
FIG. 6A is a perspective view showing an exploded state and FIG. 6B is a perspective view showing an assembled state.
Figure 6B:
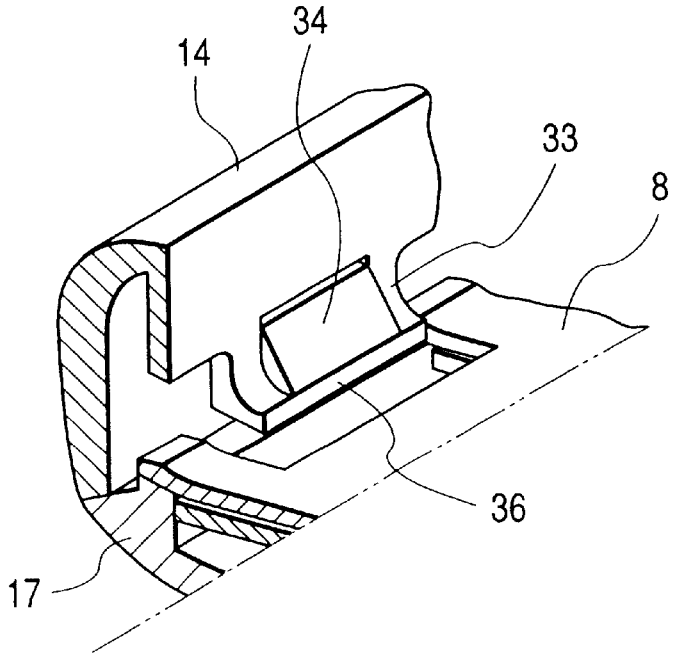
Figure 7A:
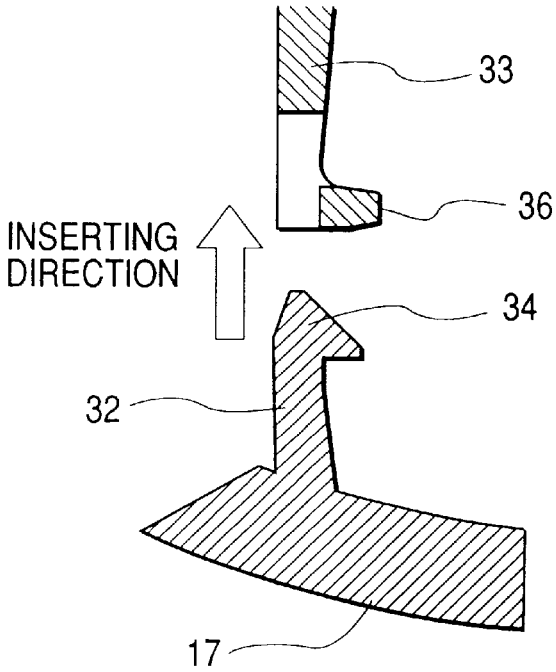
FIG. 7A and FIG. 7B are a sectional view thereof.
Figure 7B:
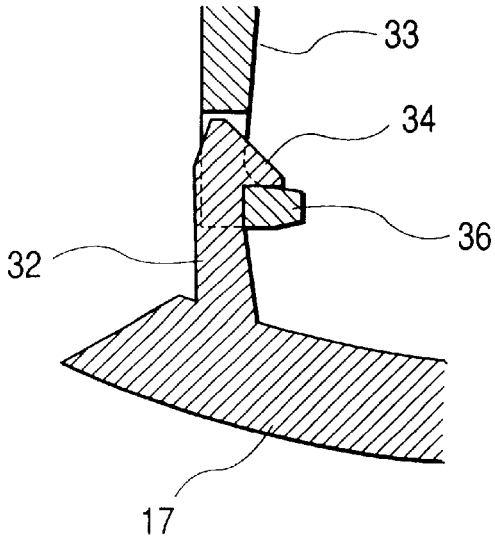

FIGS. 6A and 6B are enlarged diagrams showing each hook portion 32 of the lower case 17 and each hook receiving portion 33 of the upper case 14. As shown in FIG. 6A, a pawl 34 for engagement with the hook receiving portion 33 is formed at an upper position of the hook portion 32, while in the hook receiving portion 33 is formed a rectangular hole 35 for insertion therein of the pawl 34 of the hook portion 32. In an assembled state of the keyboard device 1, as shown in FIG. 6B, the pawl 34 of the hook portion 32 is inserted into the hole 35 of the hook receiving portion 33, and by engagement of the pawl 34 of the hook portion 32 with a horizontal bar 36 of the hook receiving portion 33, the upper case 14 and the lower case 17 are fixed together firmly. FIGS. 7A and 7B are sectional views showing positional relations between the pawl 34 of the hook portion 32 and the horizontal bar 36 of the hook receiving portion 33 before and after fixing the upper and lower cases 14, 17 by fitting.

In the conventional keyboard device the positioning of the keyboard body is performed at a longitudinal end portion, while in the keyboard device 1 of this embodiment the positioning of the keyboard body 6 is conducted by the tongue piece 18 and the third cutout portion 25 both positioned centrally in the longitudinal direction of the keyboard body 6. In the conventional keyboard device, therefore, positional deviation at the end portion opposite to the positioning side becomes large, while in the keyboard device 1 of this embodiment sufficiently high positioning accuracy can be attained even at an end portion because the distance from the positioning portion up to an end portion of the keyboard 6 becomes short. In addition, by positioning the keyboard body relative to the case 2 at two longitudinal opposed sides, it is also possible to prevent displacement of the keyboard body 6 in its rotational direction, whereby the positioning accuracy can be improved. As a result, the clearance between the edges of the window portions 15 and 16 of the upper case 14 and the key tops 3 located at the outermost periphery can be rendered uniform throughout the whole of the keyboard.

Particularly, the three components, namely keyboard body 6, upper case 14 and lower case 17, are all engaged together at the position of the tongue piece 18 of the keyboard body 6, so there accrues an advantage that the positioning accuracy among those three components is further improved. Further, since the tongue piece 18 of the keyboard body 6 is held grippingly between the tongue piece 20 of the lower case 17 and the two projections 19 of the upper case 14, the keyboard body 6 can be fixed firmly between the upper case 14 and the lower case 17.

The above two engaging portions serve not only as positioning means but also as fixing means for fixing the keyboard body 6 relative to the upper and lower cases 14, 17. In the keyboard device 1 of this embodiment, the annular fixing portions 27 are provided at two inner side positions of the keyboard body 6 and the screw bosses 29 of the upper case 14 are inserted into the holes of the fixing portions 27 and are brought into threaded engagement with the screw bosses 28 of the lower case 17, to thereby fix the keyboard body 6 and the upper and lower cases 14, 17 relative to each other. According to this construction, since the keyboard body 6 and the upper and lower cases 14, 17 are firmly fixed together at their outer peripheral portions, even if external forces are applied in various directions to the keyboard, those three components will be held in the firmly fixed state and thus it is possible to obtain a keyboard device which is strong against mechanical shocks.

The technical scope of the present invention is not limited to the above embodiment, but various modifications and changes may be made within the scope not departing from the gist of the present invention. For example, as to the various engaging portions used for positioning and fixing the keyboard body relative to the upper and lower cases in the above embodiment, their shapes, positions and numbers are not limited to those referred to in the above embodiment. A change of design may be made as necessary.

According to the keyboard device of the present invention, as set forth hereinabove, the positioning of the keyboard body is effected at longitudinally central engaging portions of the keyboard body and the distance from the positioning portion up to an end portion of the keyboard body becomes short, so that sufficiently high positioning accuracy can be attained even at the end portion and the clearance between the window edges of the upper case and the outermost peripheral key tops can be made uniform throughout the whole of the keyboard. In addition, since all the three components, namely keyboard body, upper case and lower case, are engaged together centrally in the longitudinal direction of the keyboard body, the positioning accuracy among the three components is further improved. Moreover, by positioning the keyboard body relative to the case at two opposed sides of the keyboard body, displacement of the keyboard body in its rotational direction is prevented and hence it is possible to improve the positioning accuracy. Further, since the keyboard body is fixed firmly between the upper and lower cases by virtue of the first to third engaging portions, even if external forces are applied in various directions to the keyboard, the firmly fixed state of those three components is maintained and it is possible to obtain a keyboard device which is strong against mechanical shocks despite of small size and small thickness.

What is claimed is:

1. A keyboard device comprising:

a generally rectangular keyboard body comprising an upper surface side, a lower surface, a longitudinally extending side and a plurality of key tops attached to the upper surface thereof;

a case accommodating said keyboard body therein, said case comprising an upper case covering the upper surface side of said keyboard body and a lower case covering the lower surface side of said keyboard body, said upper case having window portions through which said plural key tops are exposed;

a first body-side engaging portion provided centrally of the longitudinally extending side of said keyboard body, said first body-side engaging portion comprising a projection from the keyboard body;

a first upper case-side engaging portion to engage said first body-side engaging portion, said first upper case-side engaging portion disposed centrally in a longitudinal direction of said upper case and comprising a projection from the upper case;

a first lower case-side engaging portion to engage an engaged portion of said first body-side engaging portion, said first upper case-side engaging portion provided centrally in a longitudinal direction of said lower case and comprising a projection from the lower case, wherein the projection from the keyboard body is held grippingly between the projection from the upper case and the projection from the lower case.

2. The keyboard device according to claim 1, further comprising:

a second body-side engaging portion provided centrally of a side opposed to the longitudinally extending side of said keyboard body; and a second case-side engaging portion to engage said second body-side engaging portion provided centrally in the longitudinal direction of at least one of said upper case and said lower case.

3. The keyboard device according to claim 1, further comprising third body-side engaging portions provided at two spaced positions with said first body-side engaging portion of said keyboard body therebetween, said upper case and said lower case being respectively provided with a third upper case-side engaging portion and a third lower case-side engaging portion each to engage said third body-side engaging portion.

4. The keyboard device according to claim 2, further comprising third body-side engaging portions provided at two spaced positions with said first body-side engaging portion of said keyboard body therebetween, said upper case and said lower case being respectively provided with a third upper case-side engaging portion and a third lower case-side engaging portion each to engage said third body-side engaging portion.

5. The keyboard device according to claim 2, the second body-side engaging portion being a second projection from keyboard body and the second case-side engaging portion being a second projection from one of said upper case and said lower case.

6. The keyboard device according to claim 3, the second and third body-side engaging portions being projections from keyboard body and the second and third case-side engaging portions being projection from said upper case and said lower case.

7. The keyboard device according to claim 4, the second and third body-side engaging portions being projections from keyboard body and the second and third case-side engaging portions being projection from said upper case and said lower case.

* * * * *